US011280307B2

(12) United States Patent
Umashankar et al.

(10) Patent No.: US 11,280,307 B2
(45) Date of Patent: Mar. 22, 2022

(54) ENGINE DRIVE SYSTEM

(71) Applicant: INDIA NIPPON ELECTRICALS LIMITED, Hosur (IN)

(72) Inventors: Raman Umashankar, Hosur (IN); Bose Senthilvalavan, Hosur (IN)

(73) Assignee: INDIA NIPPON ELECTRICALS LIMITED, Hosur (IN)

( * ) Notice: Subject to any disclaimer, the term of this patent is extended or adjusted under 35 U.S.C. 154(b) by 167 days.

(21) Appl. No.: 16/606,339

(22) PCT Filed: Nov. 13, 2018

(86) PCT No.: PCT/IN2018/050742
§ 371 (c)(1),
(2) Date: Oct. 18, 2019

(87) PCT Pub. No.: WO2019/092753
PCT Pub. Date: May 16, 2019

(65) Prior Publication Data

US 2021/0293214 A1 Sep. 23, 2021

(30) Foreign Application Priority Data

Nov. 13, 2017 (IN) ..... 201741040486

(51) Int. Cl.
*F02N 11/04* (2006.01)
*F02N 19/00* (2010.01)

(52) U.S. Cl.
CPC ..... *F02N 11/04* (2013.01); *F02N 19/005* (2013.01); *F02N 2200/021* (2013.01); *F02N 2200/022* (2013.01)

(58) Field of Classification Search
CPC ..... F02N 11/04; F02N 2019/007; F02N 2019/008; F02N 19/005; F02N 2200/022; F02N 2200/021
See application file for complete search history.

(56) References Cited

U.S. PATENT DOCUMENTS 5,458,098 A * 10/1995 Yagi ..... F02N 11/08 123/179.3
5,713,320 A * 2/1998 Pfaff ..... F02N 11/006 123/179.3
2004/0000281 A1* 1/2004 Wakitani ..... F02N 11/0848 123/179.3

(Continued)

FOREIGN PATENT DOCUMENTS

EP 1 375 907 A2 1/2004
EP 1 394 405 A1 3/2004

(Continued)

*Primary Examiner* — George C Jin
(74) *Attorney, Agent, or Firm* — BakerHostetler

(57) ABSTRACT

An engine drive system comprises a processor and a control module coupled to the processor. The control module receives a signal from a crank sensor system, the signal being indicative of at least one of a speed and load of a crankshaft. Based on the signal received from the crank sensor system, the control module determines whether a load on the crankshaft is greater than a threshold value. Based on the determination, the control module controls an electrical machine coupled to the crankshaft to rotate the electrical machine in one of a forward direction and a reverse direction.

13 Claims, 4 Drawing Sheets

(56) References Cited

U.S. PATENT DOCUMENTS

| | | | | |
|---|---|---|---|---|
| 2006/0081207 | A1* | 4/2006 | Nakamura | F02N 99/006 123/179.3 |
| 2008/0105230 | A1* | 5/2008 | Kishibata | F02N 11/08 123/179.5 |
| 2013/0060455 | A1* | 3/2013 | Kawasumi | F02D 28/00 701/113 |

FOREIGN PATENT DOCUMENTS

| | | | |
|---|---|---|---|
| FR | 2 805 571 | A1 | 8/2001 |
| JP | H03-3969 | A | 1/1991 |

* cited by examiner

ENGINE DRIVE SYSTEM

CROSS REFERENCE TO RELATED APPLICATIONS

This application is a National Stage of International Application No. PCT/IN2018/050742, filed on Nov. 13, 2018, which claims priority to Indian patent application No. 201741040486, filed on Nov. 13, 2017, the disclosures of which are incorporated by reference in their entirety.

TECHNICAL FIELD

The present subject matter relates in general to an engine drive system and, in particular, to an engine drive system to optimize engine start time.

BACKGROUND

During start-up operation of an internal combustion engine an Integrated Starter Generator (ISG) is used to crank the engine and the cranking process is referenced to the crank angle of the engine. Crank angle refers to position of a crankshaft of an engine in relation to a piston of the engine. When the piston is at a Top Dead Center (TDC), the crankshaft angle is said to be at zero Crank Angle Degree (CAD). Crank angle is used to determine ignition timing, valve opening and closing sequence, sequence and quantity of fuel delivery by fuel injection apparatus, and the like. During start-up operation of the engine, typically, a large torque is a requisite for the crankshaft to go over zero CAD. This is achieved by causing the crankshaft to rotate in a reverse direction in order to start the engine.

SUMMARY OF THE INVENTION

One aspect of the application is directed to an engine drive system. The engine drive system includes a processor and a control module coupled to the processor. The processor is configured to receive, from a crank sensor system, a signal indicative of at least one of speed and load of a crankshaft of an engine. The processor is also configured to determine, based on the signal received from the crank sensor system, whether a load on the crankshaft is greater than a threshold load. The processor is further configured to control, based on the determination, an electrical machine coupled to the crankshaft to rotate the electrical machine in one of a forward direction and a reverse direction.

Another aspect of the application is directed to a method for optimizing an engine start-up time. The method includes a step of receiving, from a crank sensor system, a signal indicative of at least one of speed and load of a crankshaft of an engine. The method also includes a step of determining, based on the signal received from the crank sensor system, whether a load on the crankshaft is greater than a threshold load. The method further includes a step of controlling, based on the determination, an electrical machine coupled to the crankshaft to rotate in one of a forward direction and a reverse direction.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the drawings to reference like features and components.

DETAILED DESCRIPTION

To provide a large torque for initial start-up of an internal combustion engine, a crankshaft of the engine is rotated in a reverse direction. Reverse rotation of the crankshaft ensures that the crankshaft goes over zero Crank Angle Degree (CAD). However, reverse rotation of the crankshaft, typically, causes a delay in engine start-up time.

The present subject matter provides an engine drive system to optimize engine start-up time. In an example, the engine drive system may be an Integrated Starter Generator (ISG). The ISG has two modes of operation—viz—(1) Motoring mode in either direction when the ISG is run as a motor using power from the battery of the vehicle on which an engine is mounted and (2) Generator mode after the engine has started up to charge the battery of the vehicle. The motoring action in the starter mode has to be maintained till the engine starts and continues to run after ignition. The engine drive system may also include a crank sensor system. The crank sensor system may generate a signal indicative of at least one of a rotational speed and load of crankshaft of the engine. The engine drive system includes a processor and a control module coupled to the processor. The control module is to obtain the signal from the crank sensor system and to control an electrical machine of the engine drive system based on the detected load. The control module may control the electrical machine such that the electrical machine rotates in a forward direction. Here, rotation of the electrical machine refers to rotation of the rotor of the electrical machine. Accordingly, rotation of the electrical machine in the forward direction refers to rotation of the rotor in the forward direction. Similarly, the control module may control the electrical machine such that the electrical machine rotates in a reverse direction. Accordingly, rotation of the electrical machine in the reverse direction refers to rotation of the rotor in the reverse direction. The electrical machine is coupled to a crankshaft of the engine. The coupling of the electrical machine to the crankshaft may refer to coupling of the rotor of the electrical machine to the crankshaft.

By using the engine drive system of the present subject matter, the crankshaft is rotated in a forward direction during engine start-up, thereby, optimizing engine start-up time. Further, while the engine drive system provides for rotation of the crankshaft during start-up, the crankshaft may be rotated in the reverse direction based on the load detected by the crank sensor system during consequent strokes of the engine.

Figure 1:
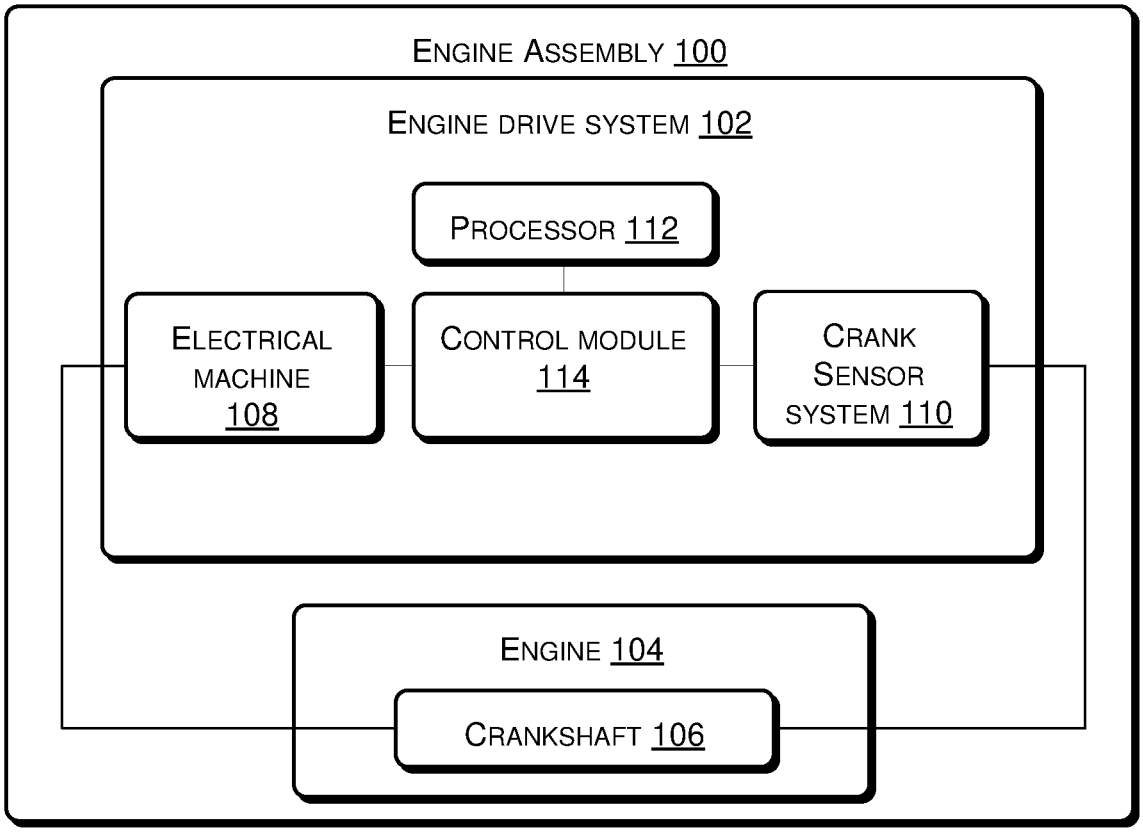
FIG. 1 illustrates an engine assembly, in accordance with an implementation of the present subject matter.

FIG. 1 illustrates an engine assembly 100, in accordance with an implementation of the present subject matter. The engine assembly 100 includes an engine drive system 102 and an internal combustion (IC) engine 104, hereinafter referred to as the engine 104. The engine 104 can be a two-stroke engine, four-stroke engine, and variants of these engines. The engine 104 includes a crankshaft 106 and a piston (not shown in FIG. 1). The crankshaft 106 is coupled to the piston and causes reciprocating motion of the piston to start and run the engine 104. The engine 104 can include other components, such as fuel injection apparatus, combustion chambers, and the like, which have not been discussed herein for sake of brevity. However, working of the other components will be as understood by a person skilled in the art.

In an example, the engine drive system 102 can be an Integrated Starter Generator (ISG). Accordingly, the engine drive system 102 may be interchangeably referred to as the ISG 102. The engine drive system 102 includes an electrical machine 108 coupled to the crankshaft 106.

The ISG 102 may run in two modes, which are a motoring or starter mode and a generator mode. The starter mode is to provide motoring torque on the crankshaft 106 prior to an initial ignition for starting the engine 104, while the generator mode is used to provide a charging voltage to the battery during operation of the engine 104. The electrical machine 108 may include various components, such as a rotor, stator, windings, armature, brushes, and other control accessories to move the ISG 102 between the two modes. The various components and control of the ISG 102 are known in art and have not been discussed herein in detail for the sake of brevity.

The ISG 102 also includes a crank sensor system 110. The crank sensor system 110 may generate a signal indicative of at least one of position, speed, and load of the crankshaft 106. In an example, the crank sensor system 110 detects and monitors a position and a rotational speed of the crankshaft 106. The position and rotational speed can be consequently related to the periodic pulses from the crank sensor system 110 during the movement of the crankshaft 106. The crank sensor system 110 may include magnetic sensors, such as Hall effect sensors, optical sensors, and inductive sensors. The following description is explained with respect to the crank sensor system 110 including Hall effect sensors. However, it is to be understood that other sensors may also be used as part of the crank sensor system 110.

The ISG 102 also comprises a processor 112. In an example, the processor 112 can be integrated with a central processor that controls the ISG 106. The processor 112 can be a microprocessor, microcontroller, and the like. The ISG 102 also includes a control module 114 coupled to the processor 112. The control module 114 may include routines, programs, objects, components, data structures, and the like, which perform particular tasks or implement particular abstract data types. Further, the control module 114 may be implemented in hardware, instructions executed by a processing unit, or by a combination thereof.

In an implementation, the control module 114 may be machine-readable instructions which, when executed by the processor 112, perform any of the described functionalities. The machine-readable instructions may be stored on an electronic memory device, hard disk, optical disk or other machine-readable storage medium or non-transitory medium.

In operation, the control module 114 receives the signal from the crank sensor system 110 and controls the ISG 102 for the motoring mode. For instance, the processor 112 causes the electrical machine 108 to operate as an electrical motor.

At engine start-up time, the ISG 102 provides initial torque to crank the crankshaft 106 in a forward direction. For this, the control module 114 may control the electrical machine 108 such that the electrical machine 108 rotates in a forward direction. Here, rotation of the electrical machine 108 refers to rotation of the rotor of the electrical machine 108. Accordingly, rotation of the electrical machine 108 in the forward direction refers to rotation of the rotor in the forward direction. The rotation of the electrical machine 108 in the reverse direction refers to the rotation of the rotor in the reverse direction. The forward direction may be, for example, clockwise rotation, and the reverse direction may be, for example, anti-clockwise direction.

The crankshaft 106, therefore, rotates in the forward direction at start-up, thereby, optimizing start-up time of the engine 104. The rotation of the crankshaft 106 is detected by the crank sensor system 110. In said example, the crank sensor system 110 provides a signal in response to change in magnetic field caused by rotation of the crankshaft 106. The signal from the crank sensor system 110 is provided to the control module 114. In an example, the crank sensor system 110 may include three Hall sensors provided 120 electrical degrees apart so that the signal from the Hall sensors can be used by the control module 114 to detect the rotational motion of the crankshaft, speed of the crankshaft, and the direction of rotation of the crankshaft. The three sensors being 120 electrical degrees apart the signals from these sensors are labelled U, V and W in FIG. 2, and will be explained with reference to FIG. 2.

The control module 114 of the ISG 102 receives the signal from the crank sensor system 110. Based on the signal received from the crank sensor system 110, the control module 114 determines whether a load on the crankshaft 106 is greater than a threshold load. The control module 114 determines whether the load on the crankshaft 106 is greater than the threshold load based on a rate of change of the signal from the crank sensor system 110 with respect to time. For example, when the signal from the crank sensor system 110 remains constant for a time period greater than a threshold time period, the control module 114 may determine that the load on the crankshaft 106 is greater than the threshold load. Accordingly, the threshold load may be said to correspond to the threshold time period. In an example, the threshold time period is 30 seconds.

Based on the determination of whether the load on the crankshaft 106 is greater or lesser than the threshold load, the control module 114 controls the electrical machine 108 of the ISG 102 coupled to the crankshaft 106 to rotate the electrical machine 108 in one of a forward direction and a reverse direction, as will be explained below:

The variation of the signal received from the crank sensor system 110 may be interpreted as low-load, i.e., a load lesser than the threshold load, by the control module 114. Therefore, the crankshaft 106 can be allowed to rotate in the forward direction. Therefore, in response to the load being determined to be lesser than the threshold load, the control module 114 controls the electrical machine 108 to rotate in the forward direction, thereby causing the crankshaft 106 to rotate in the forward direction.

However, if the signal received from the crank sensor system 110 is constant with respect to time, the control module 114 may interpret it that the load on the crankshaft 106 is a high-load, i.e., greater than the threshold load. In response to the load being determined to be greater than the threshold load, the control module 114 controls the electrical machine 108 to rotate in the reverse direction. This causes the crankshaft 106 to rotate in the reverse direction for a predetermined angle. The predetermined angle corresponds to the maximum reverse rotation of the rotor of the electrical machine 108.

The degree of reverse rotation can be controlled by control module 114 based on signal of the crank sensor system 110. For this, in an example, the control module 114 may control the electrical machine 108 to rotate in the reverse direction until the rotor reaches a predetermined angle. The predetermined angle corresponds to the maximum reverse rotation of the rotor of the electrical machine 108. Upon achieving the predetermined angle, the processor 112 controls the electrical machine 108 to rotate in the forward direction. This, in turn, causes cranking the crankshaft 106 in the forward direction till the crankshaft 106 reaches running mode, after which the engine 104 starts working normally, and the ISG 102 disengages from the starter mode, and moves to the generator mode.

Figure 2:
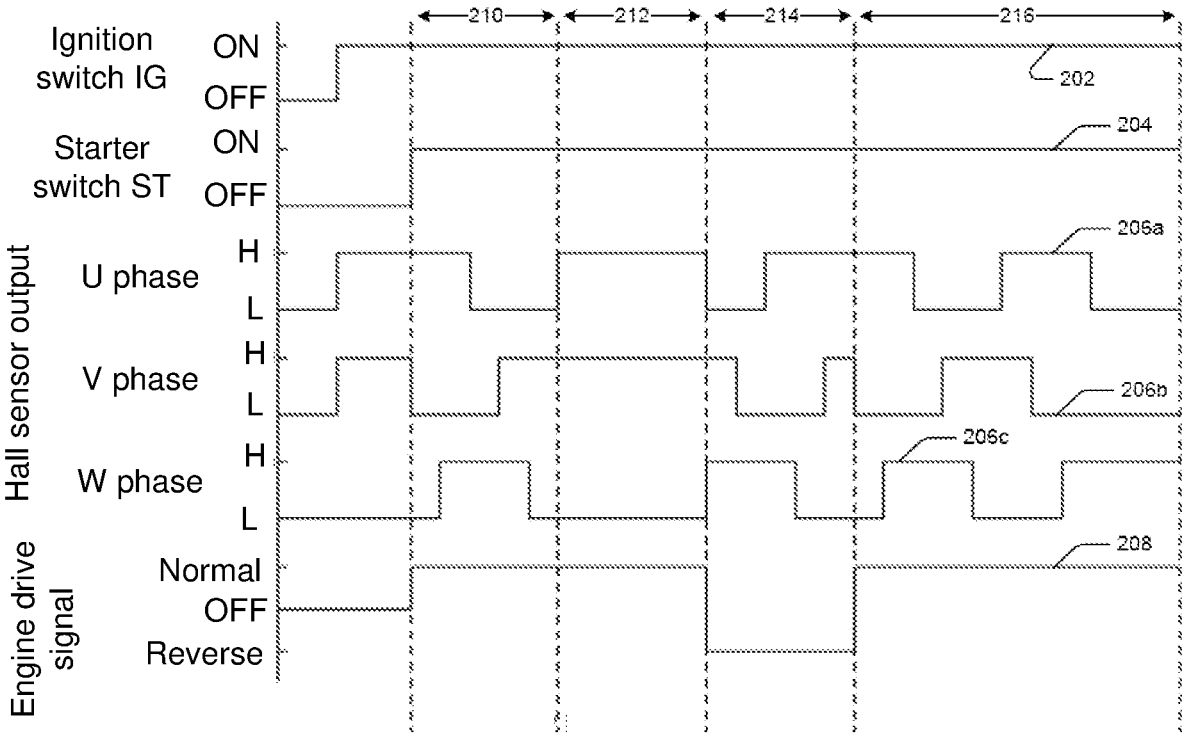
FIG. 2 illustrates graphical timing representation of stages of engine start up using the engine drive system, in accordance with an implementation of the present subject matter.

FIG. 2 illustrates graphical representation of stages of engine 104 start up using the engine drive system 102, in accordance with an implementation of the present subject matter. The engine 104 is, typically, a component in a vehicle, such as a two-wheeler, four-wheeler, and the like. The vehicle can include among other components an ignition switch and a starter switch. Typically, to start the engine 104 of the vehicle, the ignition switch is switched on and subsequently the starter switch is switched on. Waveform 202 and 204 correspond to ignition switch and starter switch, respectively.

When the starter switch is switched on and the engine 104 is in the stop condition and the Hall Effect sensors of the crank sensor system 110 senses no movement of the engine 104, the ISG controller moves to the starter mode. When the ISG 102 moves to the starter mode, the rotor of the electrical machine 108 rotates, thereby providing rotational torque to the crankshaft 106. Based on position of the crankshaft 106, coils of the Hall effect sensor (crank sensor system 110) can provide signals of corresponding to 206*a*, 206*b*, 206*c*. As shown in FIG. 2, the waveform 206*a* corresponds to U-phase, waveform 206*b* corresponds to V-phase, and waveform 206*c* corresponds to W-phase. From the waveforms as shown in 206*a*, 206*b* and 206*c*, both speed and direction of rotation of the crankshaft can be detected. Period of the waveform is indicative of speed, while sequence of U, followed by V and followed by W is direction indicative.

Therefore, for example, for the forward direction, considering time as X-axis, a right shift of the leading edge means later in time. Similarly, forward direction of U followed by V followed by W is the sequence of the leading edge and for reverse it is V followed by W followed by U. Based on the signal of the crank sensor system 110, the control module 114 determines whether the load on the crankshaft is greater than the threshold load or lesser than the threshold load. As explained earlier, such a determination is performed in response to the signal remaining constant for a time period that is greater than a threshold time. Therefore, the signal that is indicative of the speed and direction of the crankshaft is indirectly indicative of the load on the crankshaft as well. In another example, the crank sensor system 110 may provide a signal that is directly indicative of the load on the crankshaft.

Engine drive signal, indicated by waveform 208, is equivalent to signals provided by the control module 114, to a rotor of the electrical machine 108 of the ISG 102. Depending on the load, the control module 114 determines whether the rotor of the ISG 102, which is coupled to the crankshaft 106, to be rotated in the forward direction or reverse direction.

As can be seen in FIG. 2, portion 210 indicates start-up phase of the engine 104. During start-up phase, the starter switch is ON. Therefore, the electrical machine 108 of the ISG 102 provides an initial torque to crank the crankshaft 106 in response to a rotation of the electrical machine 108 in the forward direction. As can be seen in waveform 208, the engine drive signal provided by processor 112 of the ISG 102 is for causing forward rotation of the crankshaft 106. Therefore, at the start-up, the crankshaft 106 is rotated in the forward direction.

Subsequent to a start-up initiation, if a high-load is detected based on the signal from Hall sensor as indicated by portion 212, the control module 114 provides engine drive signal to the rotor of the electrical machine 108 to rotate in the reverse direction. Accordingly, in portion 214, the hall sensor signal is not moving from high to low within a prescribed time (long time between the rise and fall edge for each of the U, V and W signals indicates lower speed and so high starting torque need). As explained earlier, the signal which remains constant for a threshold time is indicative of a high load on the crankshaft 106. The crankshaft 106 coupled to the rotor of thereby rotates in the reverse direction. Rotation of the crankshaft 106 in the reverse direction is, therefore, based on the load on the crankshaft 106 and indicative that the crank is positioning the piston of the engine 104 near TDC (Top Dead Center) in the compression stroke. Therefore, reverse rotation of the crankshaft 106 is initiated only upon detection of the excessive load in the start-up phase when the crankshaft 106 rotating in the forward direction. The reversal of the direction moves the piston towards the other end of the TDC which is the BDC (Bottom Dead Center) thus reducing the load when the forward motion is re-initiated. As the crankshaft 106 rotates in the forward direction at start-up, the start-up time is reduced. Therefore, the rotation of the crankshaft 106 in a forward direction moves the piston towards Top Dead center (TDC) and the rotation of the crankshaft in a reverse direction moves the piston towards Bottom Dead Center (BDC) of the piston.

Upon the reverse rotation of the crankshaft 106 briefly for a part of the crank angle, the engine 104 enters into normal forward mode of running as indicated by portion 216. In the normal mode of forward running, the control module 114 provides the engine drive signal such that the rotor of the electrical machine 108 rotates in the forward direction, thereby causing the crankshaft 106 to rotate in the forward direction and sustaining the working of the engine 104.

Thus, by implementing the engine drive system 102, start-up time of the engine 104 can be optimized and reduced. The methods used for optimization of vehicle start-up time as discussed above will now be further described with reference to FIG.(s) 3-4.

Figure 3:
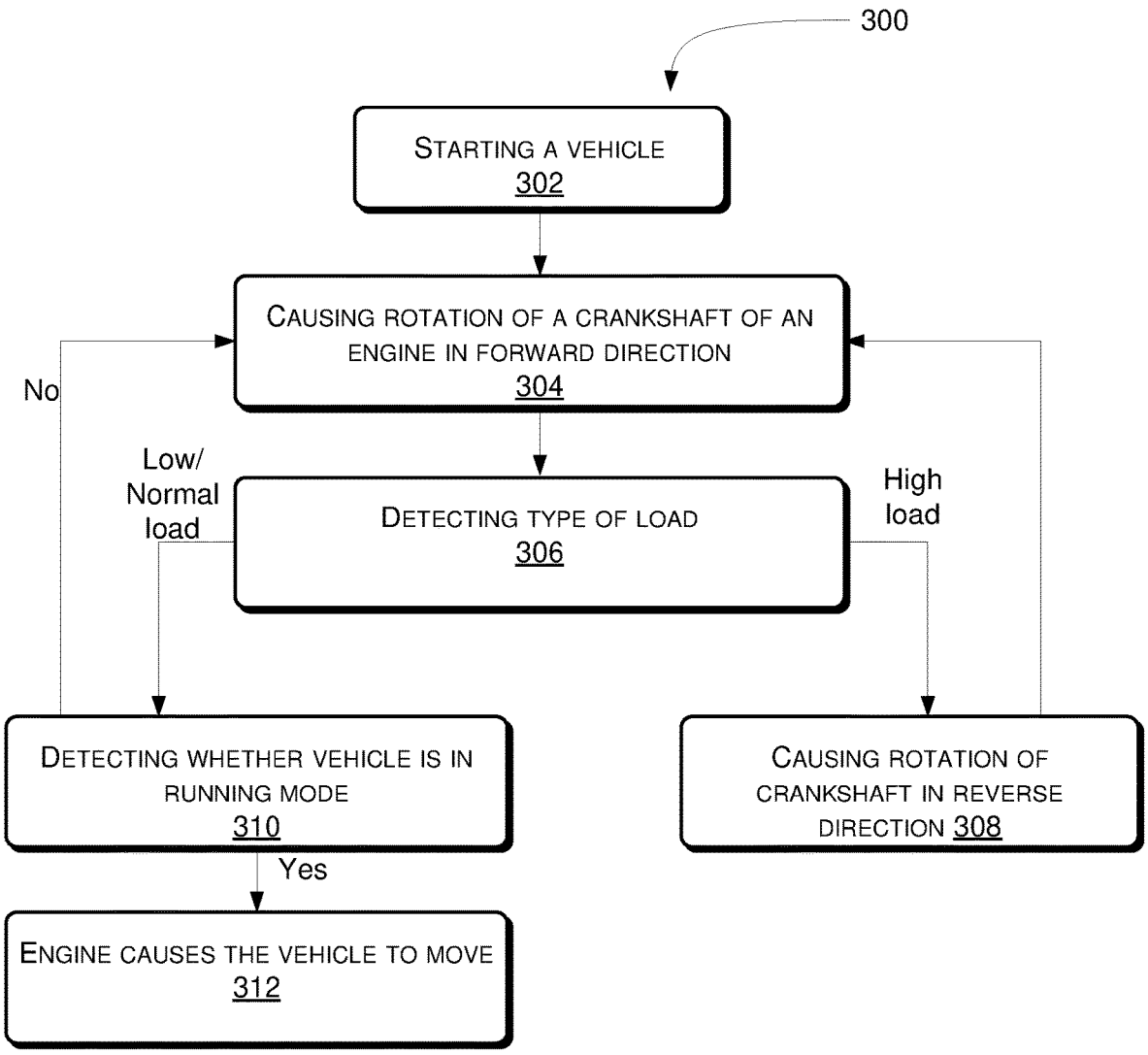
FIG. 3 illustrates an example method for optimizing engine start time, in accordance with an implementation of the present subject matter.

FIG. 3 illustrates an example method 300 for optimizing engine start-up time, in accordance with principles of the present subject matter. The order in which the method 300 is described is not intended to be construed as a limitation, and any number of the described method blocks can be combined in any order to implement method 300 or an alternative method. Additionally, individual blocks may be deleted from the method 300 without departing from the spirit and scope of the subject matter described herein. For discussion, the method 300 is described with reference to the implementations illustrated in FIGS. 1-2.

At block 302, the method 300 includes starting a vehicle. In an example, starting the vehicle comprises switching on an ignition switch which, consequently, causes switching on of a starter switch. At block 304, based on signals detected from the hall sensors, the ISG 102 is moved to the motoring mode (corresponding to rotation in the forward direction of the electrical machine 108), making the crankshaft 106 of an engine 104 of the vehicle to rotate in a forward direction.

At block 306, the method 300 comprises detection as to whether a load on the crankshaft 106 is greater or lesser than a threshold load from the timing of the U, V and W signals form the hall sensors. In an example, the detection of the load on the crankshaft 106 is based on signal of a crank sensor system 110. The detection of the load, whether high or low, is performed by a control module, for example, control module 114. In an example, the control module 114 controls rotation of the electrical machine 108 in the reverse direction until a rotor of the electrical machine 108 reaches a predetermined angle. The predetermined angle corresponds to the maximum reverse rotation of the rotor of the electrical machine 108. Thereafter, the crankshaft 106, coupled to the electrical machine 108, rotates in the reverse direction due to the rotation of the electrical machine 108 till the predetermined angle. Once the crankshaft 106 is rotated to the predetermined angle, the crankshaft 106 is caused to rotate in the forward direction as provided in block 302 and the method 300 continues therefrom.

Based on the detection at block 306, if the load on the crankshaft 106 is detected as low or normal load, at block 310, the method 300 comprises detecting whether the vehicle is in running mode. The detecting can be based on the signal provided by crank sensor system 110. If the vehicle is in running mode, the crankshaft 106 continues to rotate in the forward direction and at block 312, the engine 104 starts to generate its own torque, indicating that the starting has been achieved. However, if it is detected that the engine 104 has not reached running mode, the method 300 begins at step 304 with rotation of the crankshaft 106 in the forward direction and continues therefrom.

Therefore, by using the method 300, when the engine speed as detected by the U, V, and W signals shows that the speed realized in the forward direction is more than what the ISG 102 provided, the process of starting, i.e., motoring mode of the ISG 102 is halted. This enables the engine 104 to provide its own forward torque and subsequently the ISG 102 can be moved out of the motoring mode.

Figure 4:
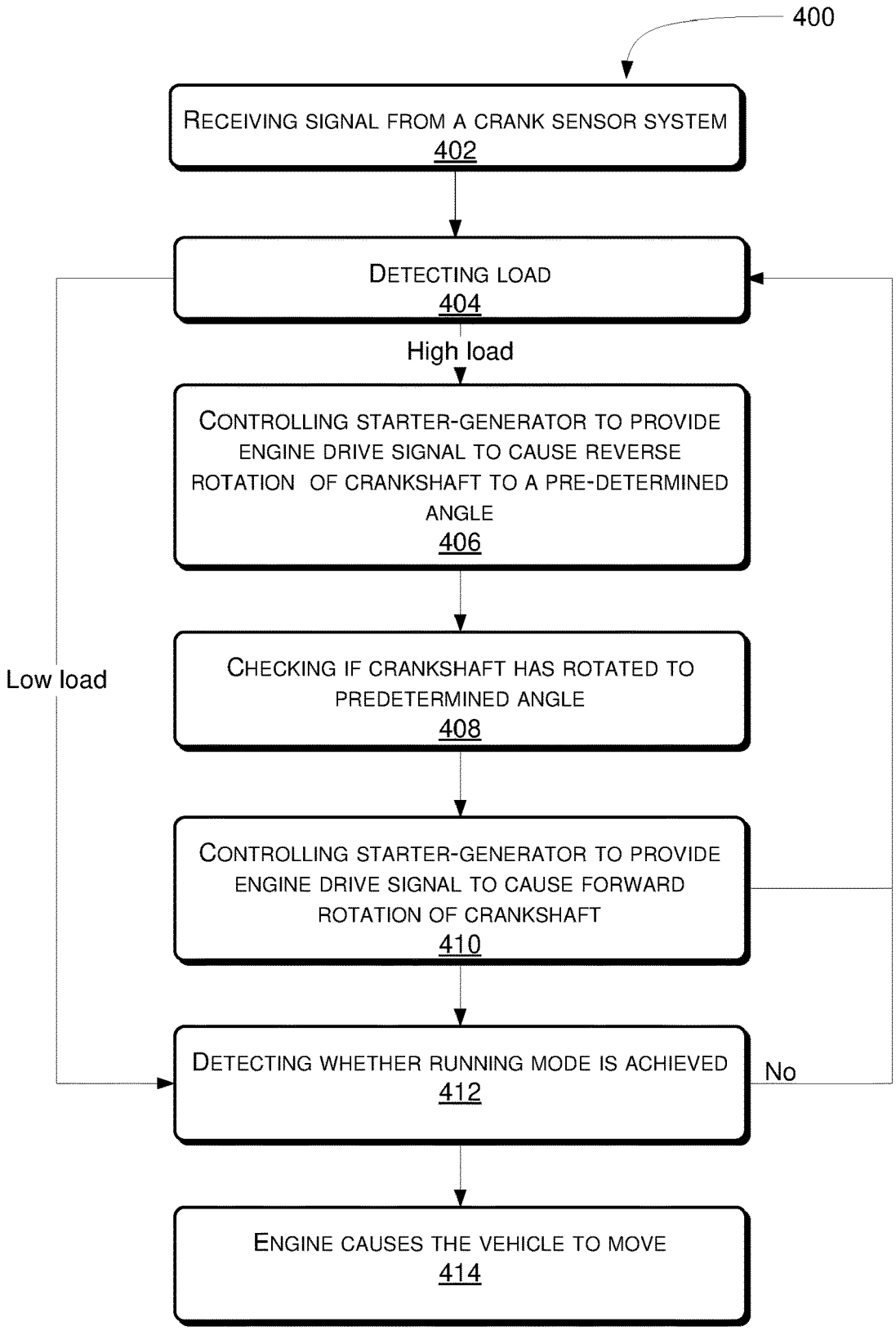
FIG. 4 illustrates another example method for optimizing engine start time, in accordance with an implementation of the present subject matter.

FIG. 4 provides an example method 400 for optimizing engine start-up time, in accordance with an implementation of the present subject matter. At block 402, signals from a crank sensor system 110 is received. The crank sensor system signal is received after the crankshaft 106 has been moved in the forward direction during start-up of an engine 104.

In an example, the control module 114 receives the signal from the crank sensor system 110. The signal from the crank sensor system 110 may refer to the signal generated by any sensor of the crank sensor system 110. For example, the crank sensor system 110 can provide the signal corresponding to waveforms 206*a*, 206*b*, and 206*c* as shown in FIG. 2 when the crank sensor system 110 comprises the Hall Effect sensors. Further, as explained previously, the waveforms 206*a*, 206*b*, and 206*b* can be used to determine speed and direction of rotation of the crankshaft 106, can be correlated to load on the crankshaft 106. Based on the signal, at block 404, type of load is detected. For example, varying signal indicates low or normal load while constant signal indicates high load. In an example, the control module 114 detects the type of load. The control module 114 determines whether the load on the crankshaft 106 is greater than the threshold load based on a rate of change of the signal from the crank sensor system 110 with respect to time. The control module 114 determines whether the load on the crankshaft 106 is greater than the threshold load in response to the signal remaining constant for a time period that is greater than a threshold time. For example, if the signal remains constant for a period of 30 seconds, the control module 114 can detect that the load is a high-load.

If it is detected that the load is the high-load, at block 406, the ISG 102 is controlled to provide a reversal of the engine drive. The control module 114 controls the crankshaft 106 to rotate in the reverse direction if the load has been determined to be greater than the threshold load. The control module 114 controls the rotation of the electrical machine 108 in the reverse direction until the rotor of the electrical machine 108 reaches a predetermined angle. The predetermined angle corresponds to the maximum reverse rotation of the rotor of the electrical machine 108. In an example, the processor 112 controls the ISG 102. The processor 112 can also be configured to determine the pre-determined angle and control the control module 114 to provide a corresponding engine drive direction.

At block 408, the method 400 comprises checking if the crankshaft 106 is rotated to the predetermined angle. For example, the control module 114 can determine the degree of reverse rotation of the crankshaft 106 based on signal of the crank sensor system 110. If the degree of reverse rotation is equal to the pre-determined angle, at block 410, the control module 114 of the ISG 102 is controlled to provide an engine drive to cause the crankshaft 106 to rotate in the forward direction. That is, the control module 114 controls the electrical machine 108 to rotate in the forward direction. The rotation of the electrical machine 108 causes the crankshaft 106 which is coupled to the rotor of the electrical machine 108 also to rotate in the forward direction. After block 410, the method 400 reverts to block 404.

At block 404, if the load detected is a low load, at block 412, running mode of the engine is detected. In an example, the control module 114 detects the running mode of the engine 104 based on the signal provided by the crank sensor system 110. If it is detected that the engine 104 is in running mode, the vehicle moves at block 414. However, if it is detected that the engine 104 is not in running mode, the method 400 reverts to block 404.

Therefore, by using the engine drive system 102 and the method of the present subject matter, the start-up time of the engine 104 is reduced. This is because the rotation of the crankshaft 106 during start-up is in the forward direction. Further, optimization of start-up time is achieved as reverse rotation of the crankshaft 106 is causes only when high-load is detected at crankshaft 106. When a high-load is not detected at the crankshaft 106, the crankshaft 106 continues to rotate in the forward direction, thereby, optimizing start-up time.

Although the subject matter has been described in considerable detail with reference to certain examples and implementations thereof, other implementations are possible. As such, the scope of the present subject matter should not be limited to the description of the preferred examples and implementations contained therein.

We claim:

1. An engine drive system comprising:

a processor; and a control module coupled to the processor to:

control an electrical machine coupled to a crankshaft to rotate the electrical machine in a forward direction;

receive, from a crank sensor system, a signal indicative of at least one of speed and load of the crankshaft of an engine while the engine is rotating in the forward direction;

determine, based on the signal received from the crank sensor system, whether a load on the crankshaft is greater than a threshold load; and control the electrical machine to continue rotation of the electrical machine in the forward direction in response to the determination the load is less than the threshold load; and control the the electrical machine to rotate the electrical machine in a reverse direction in response to the determination the load is greater than the threshold load.

2. The engine drive system of claim 1, wherein the control module is to determine whether the load on the crankshaft is greater than the threshold load based on a rate of change of the signal from the crank sensor system with respect to time.

3. The engine drive system of claim 2, wherein the control module is to determine that the load on the crankshaft is greater than the threshold load in response to the signal remaining constant for a time period that is greater than a threshold time.

4. The engine drive system of claim 1, wherein the engine drive system is an integrated starter generator (ISG).

5. The engine drive system of claim 1, comprising the crank sensor system.

6. The engine drive system of claim 5, wherein the crank sensor system is one of a Hall effect sensor, an optical sensor, or an inductive sensor.

7. The engine drive system of claim 1, wherein the control module is to:

control the crankshaft to rotate in the forward direction in response to the load being determined to be lesser than the threshold load; and control the crankshaft to rotate in the reverse direction in response to the load being determined to be greater than the threshold load.

8. An engine assembly comprising:

an engine comprising:

a crankshaft; and an Integrated Starter Generator (ISG) comprising:

an electrical machine coupled to the crankshaft to rotate the crankshaft;

a processor; and a control module coupled to the processor, wherein the control module is to:

control an electrical machine coupled to the crankshaft to rotate the electrical machine in a forward direction;

receive a signal indicative of at least one of speed and load of the crankshaft of the engine from a crank sensor system while the engine is rotating in the forward direction;

determine, based on the signal received from the crank sensor system, whether a load on the crankshaft is greater than a threshold load;

control the electrical machine to continue rotation of the electrical machine in the forward direction in response to the determination the load is less than the threshold load; and control the electrical machine to rotate the electrical machine in a reverse direction in response to the determination that the load is greater than the threshold load.

9. The engine assembly of claim 8, wherein the electrical machine is to provide an initial torque to crank the crankshaft in response to a rotation of the electrical machine in the forward direction.

10. The engine assembly of claim 8, wherein the engine comprises a piston coupled to the crankshaft, and wherein rotation of the crankshaft in a forward direction moves the piston towards Top Dead Center (TDC) of the piston and rotation of the crankshaft in a reverse direction moves the piston towards Bottom Dead Center (BDC) of the piston.

11. The engine assembly of claim 10, wherein the control module is to control rotation of the electrical machine in the reverse direction until a rotor of the electrical machine reaches a predetermined angle.

12. A method for optimizing an engine start-up time, the method comprising:

controlling an electrical machine coupled to a crankshaft to rotate the electrical machine in a forward direction;

receiving, from a crank sensor system, a signal indicative of at least one of speed and load of the crankshaft of an engine while the engine is rotating in the forward direction;

determining, based on the signal received from the crank sensor system, whether a load on the crankshaft is greater than a threshold load;

controlling the electrical machine to continue rotation of the electrical machine in the forward direction in response to the determination the load is less than the threshold load; and controlling the electrical machine to rotate in a reverse direction in response to the determination that the load is greater than the threshold load.

13. The method of claim 12 comprising, determining, by a control module, whether the load on the crankshaft is greater than the threshold load based on a rate of change of the signal with respect to time.

* * * * *